United States Patent [19]

Maresch

[11] Patent Number: 4,851,092

[45] Date of Patent: Jul. 25, 1989

[54] PROCESS FOR ELECTROLYTICALLY PICKLING CHROMIUM-CONTAINING STAINLESS STEEL

[75] Inventor: Gerald Maresch, Mödling, Austria

[73] Assignee: Maschinenfabrik Andritz Actiengesellschaft, Graz, Austria

[21] Appl. No.: 189,805

[22] Filed: May 3, 1988

[30] Foreign Application Priority Data

May 7, 1987 [AT] Austria ..... 1147/87

[51] Int. Cl.[4] ..... C25F 1/06

[52] U.S. Cl. ..... 204/145 R

[58] Field of Search ..... 204/145 R

[56] References Cited

U.S. PATENT DOCUMENTS

| | | | |
|---|---|---|---|
| 3,025,225 | 3/1962 | Snyder | 204/145 R |
| 4,363,709 | 12/1982 | Zaremski | 204/145 R |
| 4,415,415 | 11/1983 | Zaremski | 204/145 R |

FOREIGN PATENT DOCUMENTS 59-056600 4/1984 Japan .

OTHER PUBLICATIONS

"Electrolytic Descaling of 18Cr–8Ni Steel in Sodium Sulfate Solution", by Y. Furutani et al., Chem. Abstracts, vol. 87, #14, 1977, p. 396, #108322s.

"Metal Cleaning", by M. Yamamoto, Chem. Abstracts, vol. 104, No. 22, 1986, p. 271, #190761k.

Japanese Patents Gazette, Section CH: Chemical, Week 8602, 1986, Derwent Publications Ltd., London.

*Primary Examiner*—T. M. Tufariello

*Attorney, Agent, or Firm*—Fleit, Jacobson, Cohn & Price

[57] ABSTRACT

In a process for the electrolytic pickling of chromium-containing stainless steel, pickling proceeds initially in an aqueous $Na_2SO_4$ solution and subsequently in acid, preferably mixed acid. The $CrO_4^{2-}$ formed is converted by the addition of reducing agent and acid as a function of the pH value and the redox potential to $Cr_2(SO_3)_3$ or $Cr_2(SO_4)_3$. $H_2SO_4$ serves as the acid and a substance is used as a reducing agent selected from the group $Na_x H_y S_z O_v$, wherein x=0 to 2, y=0 to 2, y=1 to 6 and v=2 to 6. The pH value is adjusted to less than three by the addition of acid.

7 Claims, No Drawings

PROCESS FOR ELECTROLYTICALLY PICKLING CHROMIUM-CONTAINING STAINLESS STEEL

FIELD AND BACKGROUND

The present invention relates to a process for the electrolytic pickling of chromium-containing stainless steel, in which initially pickling takes place in an aqueous $Na_2SO_4$- solution and thereafter in acid, preferably mixed acid, optionally without electric current. Such a process as described in AT-PS No. 252.685, wherein hydro-fluoric acid plus nitric acid serve as the mixed acid. In the first step the millscale is removed; whilst in the second step the chromium-depleted layer underneath the millscale, formed during annealing, is dissolved off. That process has gained worldwide recognition, e.g. for the pickling of stainless steel strip, but suffers from the disadvantage, that the Cr in the millscale is oxidised by the current to $CrO_4^{2-}$, whilst Fe, when dissolved, is precipitated immediately as $Fe(OH)_3$. The $CrO_4^{2-}$ which is formed, remains in solution and is only removed during de-sludging, respectively together with the stainless steel strip and is only then detoxified by the reducing agent. For that purpose, primarily the reduction with an aqueous $FeSo_4$-solution in the pH-range of 0–2 respectively 7–8 have found acceptance. In both cases it is necessary subsequently to neutralise again, in order to precipitate all metal ions in the solution in the form of hydroxide. Moreover, in the event of a sudden availability of very large quantities of $CrO_4^{2-}$-containing solutions, there always exists a risk of a breakthrough of $CrO_4^{2-}$, which may then enter into the effluents. A further drawback of the process is that only a fraction of the $CrO_4^{2-}$ formed is removed from the aqueous solution by the $Na_2SO_4$, whilst the balance increases the concentration in the solution and results in increased attack on plastics pipelines and pumps.

In the publication "Chemical Abstracts", Vol. 87, No. 14, Oct. 3rd, 1977, on page 396, Abstract No. 108322s, the formation of $CrO_4$"respectively $Cr_2O_7$" is indeed described, but no solution to this problem is offered.

GENERAL DESCRIPTION OF THE INVENTION

It is an object of the invention to provide a process of the type defined in the introduction which avoids the aforesaid drawbacks.

This object is attained according to the invention in that acid and a reducing agent are added to the aqueous $Na_2So_4$- solution in accordance with the pH-value and the redox potential, such that a pickling solution is obtained which is free of $CrO_4^{2-}$.

A further development of the inventive concept provides that the pH-value of the solution is adjusted to less than 3, preferably to 1.5 to 2.5, advantageously 2, by the addition of $H_2SO_4$. In a further development of the inventive concept, provision is made that the redox potential of the solution as measured in relation to a calomel electrode is reduced by the addition of acid and reducing agent by 50 to 100 mV, a reducing agent being used in the form of a substance selected from the group $Na_xH_yS_zO_v$, wherein x=0 to 2, y=2 to 2, z=1 to 6 and v=2 to 6, and that in the reaction $Na_2SO_4$ is formed as well.

The following reaction mechanisms may illustrate the manner in which the reduction proceeds:

$$3\,Na_2So_3+3H_2SO_4+2\,H_2CrO_4 \rightarrow Cr_2(SO_4)_3+3Na_2SO_4+5\,H_2O \qquad \text{Reaction 2}$$

$$6\,Na_2S_2O_3+6H_2SO_4+2H_2CrO_4 \rightarrow Cr_2(SO_4)_3+3Na_2SO_4+3Na_2S_4O_6+8H_2O \qquad \text{Reaction 2}$$

$$3Na_2S_2O_5+3H_2SO_4+2H_2CrO_4 \rightarrow Cr_2(SO_4)_3+3Na_2S_2O_5+5H_2O \qquad \text{Reaction 3}$$

$$3Na_2S_2O_5+3H_2O \rightleftarrows 6NaHSO_3$$

$$6\,NaHSO_3+2H_2CrO_4 \rightarrow Cr_2SO_3)_3+3Na_2SO_4+5H_2O$$

$$3\,Na_2S_2O_4+3H_2SO_4+4H_2CrO_4 \rightarrow Cr_2(SO_4)_3+Cr_2(SO_3)_3+3Na_2SO_4+7\,H_2O$$

$$3\,Na_2S_2O_5+2H_2CrO_4 \rightarrow Cr_2(SO_3)_3+3Na_2SO_4+2H_2O \qquad \text{Reaction 4}$$

$$3Na_2S_2O_6+3H_2O \rightleftarrows 3NaHSO_3+3NaHSO_4$$

$$3Na_2S_2O_6+2H_2CrO_4 \rightarrow Cr_2(SO)_3+3Na_2SO_4+2H_2O$$

In addition the dissolved $Fe_2(SO_4)_3$ will also be reduced by the reducing agent, as exemplified in the following:

$$Fe_2(SO_4)_3+Na_2SO_3+H_2O \rightarrow 2FeSo_4+2NaHSO_4$$

and the $Fe_2SO_4$ thus formed will react further with $H_2CrO_4$ according to the following reaction equation:

$$2H_2CrO_4+6\,FeSO_4+6H_2SO_4 \rightarrow Cr_2(SO_4)_3+3Fe_2(SO_4)_3+8H_2O,$$

which once again adds up to the overall reaction according to reaction 1.

Due to the oxidation of these substances $Na_2SO_4$ is formed as well which in turn serves as a conductor salt in the $Na_2SO_4$ solution, and by an appropriate selection of the pH value of this solution it is possible to cause the dissolved $Fe^{3+}$ to precipitate after the solubility has been exceeded in the form of $Fe(OH)_3$, the result of which is that the solution, after a certain Fe concentration has been reached, need not be discarded completely, but need only be freed of $Fe(OH)_3$ sludge. The concentration of $Na_2SO_4$ in the solution amounts to 10 to 250 g/l, preferably 170 to 200 g/l.

The pH value for these reactions is selected according to the invention lower than 3, preferably 1.5 to 2.5, advantageously 2. At that pH value the reaction rate in the solution is adequately high and the redox potential measured against a calomel electrode in the $CrO_4^{2-}$-containing solution exceeds that of the solution free of $CrO_4^{2-}$ by 50 to 100 mV. It stands to reason that in addition to the redox potential other analytical methods may be utilised as well for the determination of the $CrO_4^{2-}$-content of the solution, although that particular method was found to be the simplest and most cost effective.

SPECIFIC EMBODIMENTS OF THE INVENTION

The following illustrative examples should be read against the background of and together with the preceding general description to enable the skilled person to practise the invention with the claimed scope thereof.

EXAMPLE 1

A stainless steel strip 1000×6.0 mm, having a strip velocity of 8.4 m/min was pickled in an electrolytical pickling plant with an aqueous solution of $Na_2SO_4$ whereafter the chromium depleted layer positioned below the millscale layer was removed in a mixed acid trough using nitric acid-hydrofluoric acid. In a freshly made up aqueous $Na_2SO_4$ solution the rise of the $Cr^{6+}$concentration amounted to 0.2 g $Cr^{6+}$/1 over a period of eight hours.

After adjustment of the pH value to 2.0 by addition of $H_2SO_4$, 96%, the total $Cr^{6+}$was reduced by the further addition of 8.8 ml 10% $Na_2SO_3$ solution and 3.7 ml 96% $H_2SO_4$ per liter of the aqueous solution whilst the redox potential of the solution changed from a previous 620 mV to 530 mV, measured against a calomel electrode.

During the subsequent eight hours this redox potential was kept constant by further constant addition of $Na_2SO_3$ solution as well as sulphuric acid. Towards the end of the eight hour period no further $Cr^{6+}$could be detected analytically in the aqueous solution.

EXAMPLE 2

Subsequent to Example 1 the addition of reducing agent was stopped until the redox potential had again risen to 620 mV. After approximately a further 4 hours the analytically determined $Cr^{6+}$ concentration amounted to 0.11 g $Cr^{6+}$/1. By the addition of solid $Na_2S_2O_5$ in an amount of 0.9 g $Na_2S_2O_5$ (62%) per liter, it was possible to reset the redox potential once again to 520 mV, as measured against a calomel electrode and analytically no $Cr^{6+}$ could be detected any more. During the addition of the $Na_2S_2O_5$ the pH value of the solution dropped from 2.0 to 1.9.

EXAMPLE 3

After the addition according to Example 2 the addition of a reducing agent to the aqueous solution was interrupted once again until again a $Cr^{6+}$concentration of 0.16 g $Cr^{6+}$/1 had been attained. By the addition of 3.9 ml 10% $Na_2S_2O_4$ solution as well as 1.3 ml 96% $H_2SO_4$ per liter of solution the redox potential was reset to 515 mV and no $Cr^{6+}$ could be detected any more analytically.

In all examples the stainless steel strip was free of millscale and had a silvery lustre after the treatment with acid or mixed acid respectively.

The claims which follow are part of the present disclosure.

What we claim is:

1. Process for the electrolytic pickling of chromium-containing stainless steel, in which initially pickling proceeds in an aqueous $Na_2SO_4$ solution and thereafter in acid, comprising the improvement of adding acid and a reducing agent to the aqueous $Na_2SO_4$ solution in amounts regulated in accordance with pH value and the redox potential of the solution such that a pickling solution free of $CrO_4^{2-}$ is attained.

2. Process according to claim 1, wherein the pH value of the solution is adjusted to less than 3 by the addition of $H_2SO_4$.

3. Process according to claim 2, wherein the pH is adjusted to 1.5 to 2.5.

4. Process according to claim 1, wherein the redox potential of the solution measured against a calomel electrode is reduced by 50 to 100 mV by the addition of acid and the reducing agent.

5. Process according to claim 1, wherein a compound of the formula $Na_xH_yS_zO_v$ is used as the reducing agent, wherein x=0 to 2, y=0 to 2, z=1 to 6 and v=2 to 6; and wherein in the reaction $Na_2SO_4$ is formed as well.

6. Process according to claim 1, wherein the $Na_2SO_4$ concentration of the solution is adjusted to 100 to 250 g/l.

7. Process according to claim 6, wherein the $Na_2SO_4$ concentration is adjusted to 170 to 200 g/l.

* * * * *